US005329342A

United States Patent [19]

Shirai et al.

[11] Patent Number: 5,329,342

[45] Date of Patent: Jul. 12, 1994

[54] IMAGE FIXING APPARATUS

[75] Inventors: Masanari Shirai, Chigasaki; Kazuo Kagiura, Tokyo; Hiroyoshi Maruyama, Yokohama; Masashi Ohashi, Tokyo; Tatsuya Shiratori, Kawasaki; Naomasa Kimura; Yoshikuni Toyama, both of Yokohama, all of Japan

[73] Assignee: Canon Kabushiki Kaisha, Tokyo, Japan

[21] Appl. No.: 65,021

[22] Filed: May 24, 1993

Related U.S. Application Data

[63] Continuation of Ser. No. 703,709, May 21, 1991, abandoned, which is a continuation of Ser. No. 314,798, Feb. 24, 1989, abandoned.

[30] Foreign Application Priority Data

Feb. 29, 1988 [JP] Japan ..... 63-46885

[51] Int. Cl.[5] ..... G03G 15/20

[52] U.S. Cl. ..... 355/285; 219/216; 355/203; 355/289; 355/290

[58] Field of Search ..... 355/282-285, 355/289, 290, 295, 203, 204, 206, 208; 219/216, 469, 471

[56] References Cited

U.S. PATENT DOCUMENTS

| | | | |
|---|---|---|---|
| 3,809,855 | 5/1974 | Neal | 219/471 X |
| 4,301,359 | 11/1981 | Ito et al. | 219/469 |
| 4,372,675 | 2/1983 | Sahay | 355/282 |
| 4,541,708 | 9/1985 | Shigeuobu | 355/282 X |
| 4,585,325 | 4/1986 | Euler | 355/290 |
| 4,603,245 | 7/1986 | Yagasaki | 355/285 X |
| 4,821,062 | 4/1989 | Katoh et al. | 355/285 X |
| 4,821,069 | 4/1989 | Kusumoto | 355/285 X |
| 4,914,476 | 4/1990 | Nishitsuji et al. | 355/208 |
| 4,933,724 | 6/1990 | Sugimoto et al. | 355/259 |
| 4,994,852 | 2/1991 | Matsuuchi | 355/206 |
| 5,032,874 | 7/1991 | Matsuuchi | 355/285 |

FOREIGN PATENT DOCUMENTS

| | | | |
|---|---|---|---|
| 0314099 | 5/1989 | European Pat. Off. | 355/203 |
| 0132772 | 8/1983 | Japan | 355/285 |
| 0159565 | 9/1983 | Japan | 355/285 |
| 0159566 | 9/1983 | Japan | 355/285 |
| 0191280 | 9/1985 | Japan | 355/285 |
| 0208080 | 9/1987 | Japan | 355/285 |

OTHER PUBLICATIONS

IBM Technical Disclosure Bulletin, vol. 21, No. 6, Nov. 1978, pp. 2228-2229, L. M. Ernst and W. E. McCollou, "Fuser Temperature Control Circuit."

*Primary Examiner*—Matthew S. Smith

*Attorney, Agent, or Firm*—Fitzpatrick, Cella, Harper & Scinto

[57] ABSTRACT

An image fixing apparatus includes a rotatable member for being heated by a heating source to fix an image on an image supporting member, first and second detecting elements responsive to temperature of the rotatable member, and wherein the first and second detecting elements are disposed on substantially the same circumferential line of the rotatable member.

4 Claims, 2 Drawing Sheets

IMAGE FIXING APPARATUS

This application is a continuation of application Ser. No. 07/703,709 filed May 21, 1991, now abandoned, which is a continuation application of Ser. No. 07/314,798, filed Feb. 24, 1989, abandoned.

FIELD OF THE INVENTION AND RELATED ART

The present invention relates to an image fixing apparatus, usable with an electrophotographic copying apparatus or the like, for fixing an unfixed image, more particularly to such an image fixing apparatus wherein the unfixed image is fixed by heat.

Recently, an image fixing apparatus is widely used wherein an image supporting member is passed through a nip formed between two rotatable members, during which heat and pressure are applied thereto to fix the image, since such a type of apparatus is advantageous from the standpoint of image fixing properties and the smallness of the size of the apparatus. In the apparatus wherein the heat and pressure are applied to the unfixed image by a pair of rotatable members, it is required that the temperature of a surface of a rotatable member for heating the image is maintained constant. Therefore, the surface temperature is detected by a thermister or the like, and in response to the detection, the amount of heat generation of the heating source for heating the heating rotatable member is controlled.

On the other hand, the heating rotatable member can be overheated by erroneous operation of the control circuit for the heating source or the erroneous operation of the temperature detecting element, and if it occurs, the heating source can be damaged, or the rotatable member is fused. In order to prevent this, a thermoswitch or the like is employed to detect the overheating of the heating rotatable member above a predetermined temperature and then to shut off the heating source.

The heating rotatable member is so designed that the surface temperature thereof is uniform along the length thereof to prevent non-uniform image fixation, and therefore, the thermister and the thermoswitch are disposed spaced apart from each other along the length of the rotatable member.

Referring first to FIG. 3, there is shown an image fixing apparatus having this structure, wherein the heating roller is designated by a reference numeral 2 as being in contact with the unfixed image. The heating roller 2 contains therein a heater 11. A back-up or pressing roller is contacted to the heating roller 2. The pressing roller 3 and the heating roller 2 constitute a nip therebetween, through which a recording material supporting the unfixed image is passed, while the heat and the pressure are being applied thereto to fix the image. The thermoswitch 7 and the thermister 8 are disposed as shown in this Figure.

The temperature at the point of position where the thermister is provided and the temperature at the point of position where the thermoswitch is provided, are sometimes different due to non-uniform heat distribution provided by the heater and/or due to the larger heat radiation at the longitudinal ends of the rotatable member. If this occurs, problems arise. Firstly, the operation temperature of the thermoswitch has to be predetermined with the variation of the temperature at the thermoswitch position relative to the thermister position taken into account, for the individual image fixing machines. Secondary, the operation with unstable. When the heating rotatable member is overheated due to an error in the thermister or the temperature control system, for example, the heating apparatus continues to be heated until the thermoswitch detects the overheating. If, the thermoswitch setting temperature is too high, the time period to the detection of the overheat becomes longer, so that the heating rotatable member can be extremely overheated, with the disadvantages of possible damage of the parts around the image fixing apparatus, with the result of increased time and cost for repairing them.

In order to minimize the damage, the thermal durability of those parts has to be increased, with the result that the productivity is degraded due to the use of the heat durable material and that expensive parts have to be used. In view of these, it is desired that the thermoswitch setting temperature is decreased. However, if it is too low, the heater is shut off when a slight overshoot of the heater occurs, and therefore, the normal image fixing operation is easily obstructed.

Accordingly, many inconveniences are involved if the thermoswitch setting temperature is determined in consideration of the variations for individual products.

SUMMARY OF THE INVENTION

Accordingly, it is a principal object of the present invention to provide an image fixing apparatus wherein the temperatures of the surface of the rotatable member detected by two temperature detecting members are not different even if there are variations for individual product.

It is another object of the present invention to provide an image fixing apparatus wherein two temperature detecting elements are disposed substantially on the same circumference of the rotatable member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
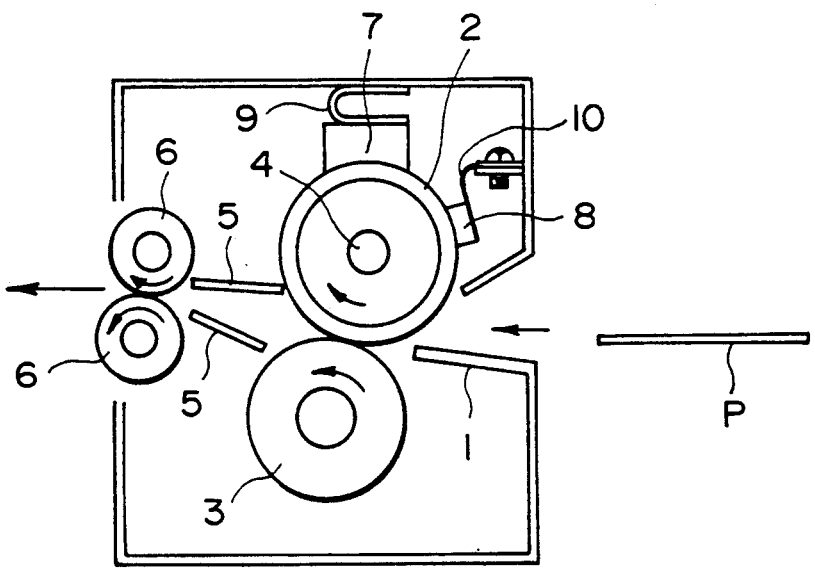
FIG. 1 is a sectional view of an image fixing apparatus according to an embodiment of the present invention.

The preferred embodiments of the present invention will be described in conjunction with the accompanying drawings wherein like reference numerals are assigned to the element having the like functions throughout the drawings.

Referring to FIG. 1, there is shown an image fixing apparatus according to an embodiment of the present invention. A recording material or sheet P having an unfixed toner image thereon is conveyed from a conveying station not shown, and is guided by an inlet guide 1 into a nip formed between a heating roller (a heating rotatable member) 2 and a back-up or pressing roller (a back-up or pressing rotatable member) 3. The unfixed toner image is fixed on the recording sheet P by the heat provided by the heating roller 2 and the pressure provided by the pressing roller 3. The heating roller 2 is a hollow cylinder containing thereon a heating source or heater in the form of a halogen lamp 4 or the like. The surface of the heating roller 2 is coated with a fluorine resin exhibiting good parting properties. The pressing roller 3 is coated with a silicone rubber and shows soft or elastic property.

The recording sheet P on which the image is fixed by the pair of rollers is guided by the guide 5 to a pair of discharging rollers 6, by which it is discharged outside.

Adjacent to the surface of the heating roller 2, there are disposed a thermoswitch 7 for detecting overheating of the heating roller 2 and a thermister 8 for detecting the temperature of the surface thereof to control the energization of the heater so as to maintain a constant surface temperature of the heating roller. Those elements 7 and 8 are lightly pressed and contacted to the surface of the heating roller by resilient members 9 and 10 such as leaf springs or the like. Usually, the amount of heat generation by the heater 4 is controlled in response to the detection by the thermister 8, whereas the heater 4 is shut-off when the thermoswitch 8 detects the overheat.

Figure 2:
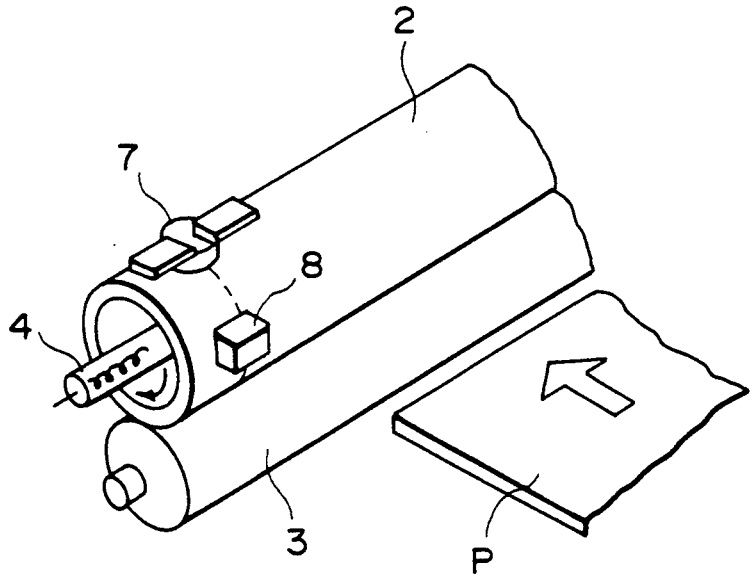
FIG. 2 is a perspective view of FIG. 1 apparatus wherein positions of the thermister and thermoswitch are shown.
Figure 3:
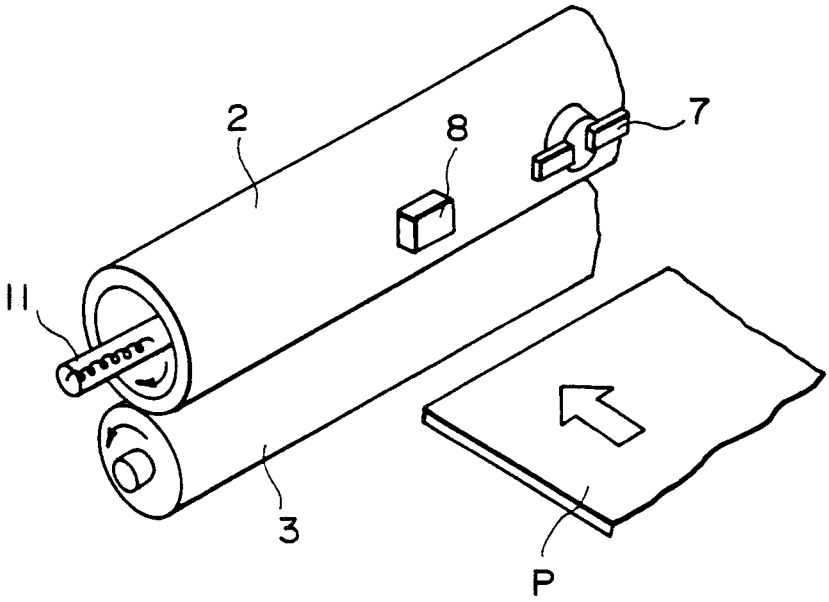
FIG. 3 is a perspective view of a conventional image fixing apparatus.

As will be understood from FIG. 2 which is a perspective view of the apparatus of FIG. 1, the thermister 8 and the thermoswitch 7 are disposed on one and the same circumferential line of the heating roller (broken line).

By disposing those temperature sensing elements in this manner, more particularly, by disposing the temperature detecting element and the overheat detecting elements on the same circumferential line, there is hardly any difference between the temperature detected by the temperature detecting element and the temperature detected by the overheating detecting element, and therefore, the setting temperature of the overheating detecting element can be set property relative to the control temperature of the heating roller.

Therefore, the adverse affect by the variation in the temperature difference between the temperature detecting element and the overheating detecting element can be avoided. The preferable positions of the thermister 8 and the thermoswitch 7 are such that they are disposed on the same circumferential line outside a longitudinal region of the heating roller wherein the recording material passes. By doing so, the contact region between the thermister and the heating roller and between the thermoswitch and the heating roller is small, and simultaneously, the region is outside the recording material passing region, and therefore, the image on the recording sheet is not influenced by a possible damage in the heating roller by those elements. Further, it is preferable that the thermoswitch 7 is disposed upstream of the thermister with respect to the circumferential movement of the surface of the heating roller. This is because the thermoswitch 7 is effective to remove contamination from the heating roller by which contamination of the portion of the thermister which is contacted to the heating roller can be decreased. Therefore, the accuracy of the temperature detection by the thermister is improved, whereby the temperature control by the thermister 8 is stabilized.

Also, it is preferable that the temperature or heat distribution provided by the heater 4 is such that the portion where the thermister 8 and the thermoswitch 7 are disposed is higher than at least the recording material passage region, further preferably, the temperature distribution has a heat in this region.

Therefore, the safety and quick thermal response are further improved.

In the embodiment shown in FIGS. 1 and 2, no mechanism or means is provided for cleaning the heating roller to remove the offset toner therefrom or for applying parting agent such as silicone oil or the like to the heating roller. This is possible by sufficiently enhancing the parting property of the heating roller surface and that of the pressing roller surface. By doing so, a sufficient space can be provided around the periphery of the heating roller 2 so as to permit the thermister and the thermoswitch to be disposed substantially on one circumferential line of the heating roller without difficulty.

The present invention is applicable not only to the heating roller but also to a rotatable member movable along an endless path. When the rotatable member contained therein a heating source, the distances between the heating source and the surface of the rotatable member in the surface temperature detecting portion and the overheating detecting portion are preferably substantially the same.

While the invention has been described with reference to the structures disclosed herein, it is not confined to the details set forth and this application is intended to cover such modifications or changes as may come within the purposes of the improvements or the scope of the following claims.

What is claimed is:

1. An image fixing apparatus comprising:

a rotatable heating member having a heating source;

a single temperature detecting member for detecting a temperature of a surface of said rotatable heating member to maintain a predetermined temperature by controlling power supply to said heating source; and an overheating preventing member for stopping power supply to the heating source upon overheating of said heating member.

wherein said temperature detecting member and overheating preventing member are provided to said rotable heating member outside a supporting member passing region, and wherein said heating source has a heat distribution which is higher adjacent said temperature detecting member and said overheating preventing member than adjacent the supporting member passing region.

2. An apparatus according to claim 1, further comprising a back-up rotatable member press contacted to said rotatable heating member to form a nip therebetween, wherein said temperature detecting member is within a width region of the nip in a generating line direction of said rotatable heating member.

3. An apparatus according to claim 1, wherein said temperature detecting member and said overheat preventing member are disposed on substantially the same circumferential line of said rotatable heating member.

4. An apparatus according to claim 3, further comprising a back-up rotatable member press contacted to said rotatable heating member to form a nip therebetween, wherein said temperature detecting member is disposed upstream of the nip and downstream of said overheat preventing member, with respect to a rotational direction of said rotatable heating member.

* * * * *

UNITED STATES PATENT AND TRADEMARK OFFICE

CERTIFICATE OF CORRECTION

PATENT NO. : 5,329,342
DATED : July 12, 1994
INVENTOR(S) : MASANARI SHIRAI, ET AL.

It is certified that error appears in the above-indentified patent and that said Letters Patent is hereby corrected as shown below:

On the title page, item [56]: References cited:
line OP, "W.E. McCollou," should read --W.E. MCColum,--.

Column 1,
line 36, "thermos-" should read --thermo- --; and
line 37, "witch" should read --switch--.

Column 2,
line 17, "thermos-" should read --thermo- --; and
line 18, "witch" should read --switch--.

Column 13,
line 40, "affect" should read --effect--;
Col. 4, line 41, "member." should read --member,--;
line 44, "rotable" should read --rotatable--;
line 57, "overheat" should read --overheating--; and
line 65, "overheat" should read --overheating--.

Signed and Sealed this

Thirteenth Day of December, 1994

*Attest:*

*Attesting Officer*

BRUCE LEHMAN

*Commissioner of Patents and Trademarks*